United States Patent [19]

Howe

[11] 4,255,847

[45] Mar. 17, 1981

[54] METHOD OF MAKING A KNOCKDOWN CENTRALIZER

[75] Inventor: Thomas W. Howe, Duncan, Okla.

[73] Assignee: Halliburton Company, Duncan, Okla.

[21] Appl. No.: 67,102

[22] Filed: Aug. 16, 1979

Related U.S. Application Data

[62] Division of Ser. No. 957,552, Nov. 3, 1978, Pat. No. 4,219,081.

[51] Int. Cl.[3] ..... B23P 9/00

[52] U.S. Cl. ..... 29/445; 29/463; 29/505

[58] Field of Search ..... 29/445, 446, 463, 526 R, 29/505; 166/241; 285/419; 403/344, 364

[56] References Cited

U.S. PATENT DOCUMENTS

| | | | |
|---|---|---|---|
| 1,052,198 | 2/1913 | Wyre | 285/419 X |
| 1,951,306 | 3/1934 | Johannsen et al. | 29/445 |
| 2,360,793 | 10/1944 | Rachlin et al. | 29/445 UX |
| 2,738,019 | 3/1956 | Atkinson | 166/241 |
| 2,753,962 | 7/1956 | McBerty | 29/463 UX |
| 3,126,043 | 3/1964 | Simon | 29/445 UX |
| 3,356,147 | 12/1967 | Dreyfuss | 166/241 |
| 3,385,368 | 5/1968 | Solum et al. | 29/466 X |
| 3,566,965 | 3/1971 | Solum | 166/241 |
| 4,088,186 | 5/1978 | Callihan | 166/241 |
| 4,143,713 | 3/1979 | Kreft | 166/241 |

FOREIGN PATENT DOCUMENTS

| | | | |
|---|---|---|---|
| 462861 | 7/1928 | Fed. Rep. of Germany | 403/344 |
| 2545181 | 4/1976 | Fed. Rep. of Germany | 166/241 |
| 1014736 | 12/1965 | United Kingdom | 166/241 |
| 1156710 | 7/1969 | United Kingdom | 166/241 |

*Primary Examiner*—Charlie T. Moon

*Attorney, Agent, or Firm*—John H. Tregoning; James R. Duzan; Lucian Wayne Beavers

[57] ABSTRACT

An improved centralizer includes upper and lower collars with a plurality of spring members attached at upper and lower ends to said collars. Each of said collars includes a first and second arcuate collar portion. A first peripheral end portion of said first collar portion includes a radially outward projecting channel. A second peripheral end portion of said second arcuate collar portion includes a radially inward projecting channel which overlaps with said outward projecting channel to define an axially extending hole which receives a latch pin. A novel connection between the collars and spring members is also provided. The collars include a continuous integrally formed peripherally extending bar spaced radially outward from a radially outer surface of the collars, upper and lower peripheral slots adjacent upper and lower edges of the bar and an upper compression bearing surface. An end of each spring member includes a radially inward projecting peripherally extending channel having a middle part with first and second legs projecting from said middle part, so that said peripherally extending bar is received within said peripherally extending channel.

4 Claims, 22 Drawing Figures

METHOD OF MAKING A KNOCKDOWN CENTRALIZER

This application is a Divisional application of my prior U.S. Application Ser. No. 957,552 filed Nov. 3, 1978, now U.S. Pat. No. 4,219,081, issued Aug. 26, 1980.

This invention relates generally to centralizers for locating a pipe string concentrically within a well bore, and more particularly, but not by way of limitation, to a knockdown centralizer which can be disassembled for space efficient shipping and can be easily reassembled on the job site.

Centralizers typically include upper and lower collars with a plurality of spring members attached at their upper and lower ends to the collars. The collars are typically constructed of two or more arcuate portions with some means for joining the collar portions together after they are placed around a pipe. The spring members may be welded to the collars or they may be mechanically attached by means of bolts, snap-in connectors, locking tabs or the like.

One major factor in the design of many centralizers is the manner in which they may be disassembled for shipping, and the ease with which they may be reassembled on the job site. A fully assembled centralizer occupies a great volume compared to its relatively small weight. This causes the shipping costs of centralizers to distant locations to be excessive for any centralizer which cannot be disassembled and packed in a container of a volume significantly less than that which is occupied by a fully assembled centralizer. Another equally important consideration, however, is that the centralizer must be easily reassembled and installed in the field. Also, the centralizer must be structurally sound, once assembled, so that it will not be damaged by the rough treatment encountered in a well.

The centralizer of the present invention meets all these requirements by providing a design including collars comprising a plurality of arcuate collar portions with a novel configuration of interlocking joints between the arcuate collar portions. Also, a novel connection between the collars and spring members is provided. This design allows an embodiment of the centralizer of the present invention to be completely knocked down or disassembled for packing, thereby greatly reducing the volume occupied by the centralizer during shipping.

The interlocking joints between the arcuate collar portions include a radially outward projecting channel on a first arcuate collar portion, and a radially inward projecting channel on a second collar portion, said inward projecting channel overlapping said outward projecting channel to define an axially extending hole which receives a locking pin.

The prior art includes numerous types of interlocking joints between arcuate collar portions, most of which include a plurality of overlapping loops defining an axial hole for receiving a latching pin or pivot pin. Examples of these prior art devices are seen in U.S. Pat. Nos. 3,929,388 to Sutko et al., 3,566,965 to Solum, 3,379,258 to Turbyfill, 3,000,444 to Wright et al., and Italian Pat. No. 612,843 to Weatherford Oil Tool Company, Inc. The overlapping loops of those devices are, however, much more difficult and expensive to form than are the overlapping channels of the present invention. Also, the collar portions of those devices do not have peripherally extending lips for engagement with adjacent collar portions, and therefore, they do not provide the rigid interlocking of adjacent collar portions that is provided by the present invention.

The improved spring member to collar connection of the present invention includes a collar having a continuous integrally formed peripherally extending bar spaced radially outward from a radially outer surface of the collar, upper and lower peripheral slots adjacent upper and lower edges of the bar, and an upper compression bearing surface extending radially outward from said radially outer surface of the collar. It also includes a spring member, an end of which includes a radially inward projecting peripherally extending channel having a middle part with first and second legs projecting substantially perpendicular from said middle part, so that said peripherally extending bar is received within said peripherally extending channel.

Several prior art devices include peripherally extending bars spaced radially outward from the collar with one upper leg of a spring member projecting perpendicularly through a single slot above the bar. Such structure is found in U.S. Pat. Nos. 3,566,965 to Solum, 2,738,019 to Atkinson, and 2,680,488 to Atkinson. None of these devices, however, have two perpendicular channel legs extending through upper and lower slots. Such a design doubles the bearing area of the connection under both a compression and a tensile load.

In an alternative embodiment, the second leg of the spring member end projects at an acute angle to said middle part. Said slots and legs of said alternative embodiment are so constructed and dimensioned that when said centralizer is axially loaded in compression said first leg engages said upper compression bearing surface, but an axial clearance remains between said second leg and a lower compression bearing surface of said bar. If said upper compression bearing surface yields due to an excessive compression load, then said second leg engages said lower compression bearing surface to provide additional support.

Acutely angled legs are shown, for example, in U.S. Pat. Nos. 4,077,470 to Dane, 4,042,022 to Wills et al., and German Pat. No. 2,545,181 to Wills et al. It is believed, however, that those references do not show radially outward spaced bars, nor are those bars continuous. Furthermore, those references do not appear to be so constructed as to allow compression loading of the second leg only after yielding of an upper compression bearing surface.

FIG. 6 is a partial elevation view of the centralizer of FIG. 5 taken along lines 6—6 showing an elevation view of the wrap-around hinge.

Figure 1:
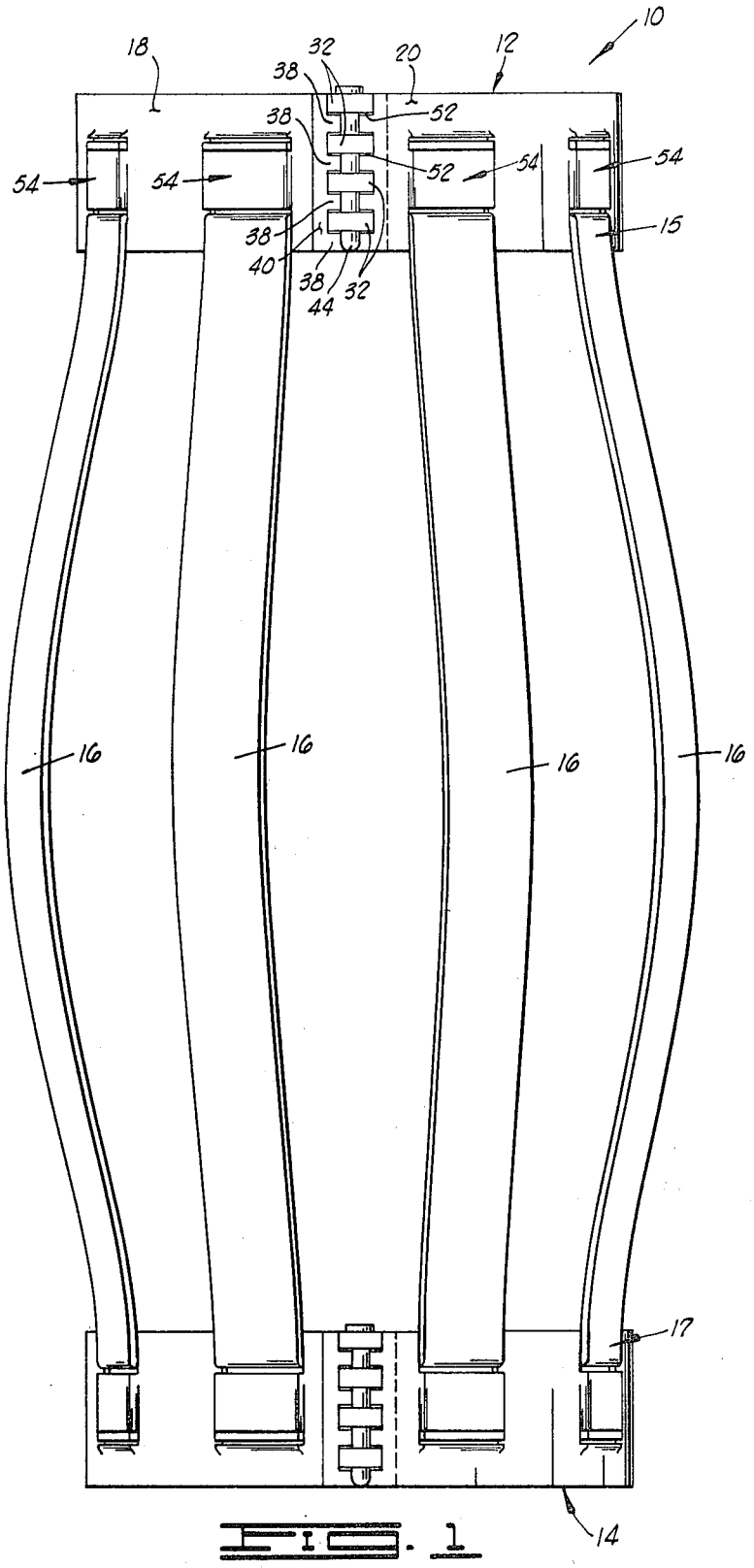
FIG. 1 is an elevation view of the centralizer of the present invention.

Referring now to the drawings and particularly to FIG. 1, the centralizer of the present invention is shown and generally designated by the numeral 10. The centralizer 10 includes an upper collar 12, a lower collar 14 and a plurality of spring members 16. Each of the spring members 16 includes an upper end 15 and a lower end 17.

Figure 2:
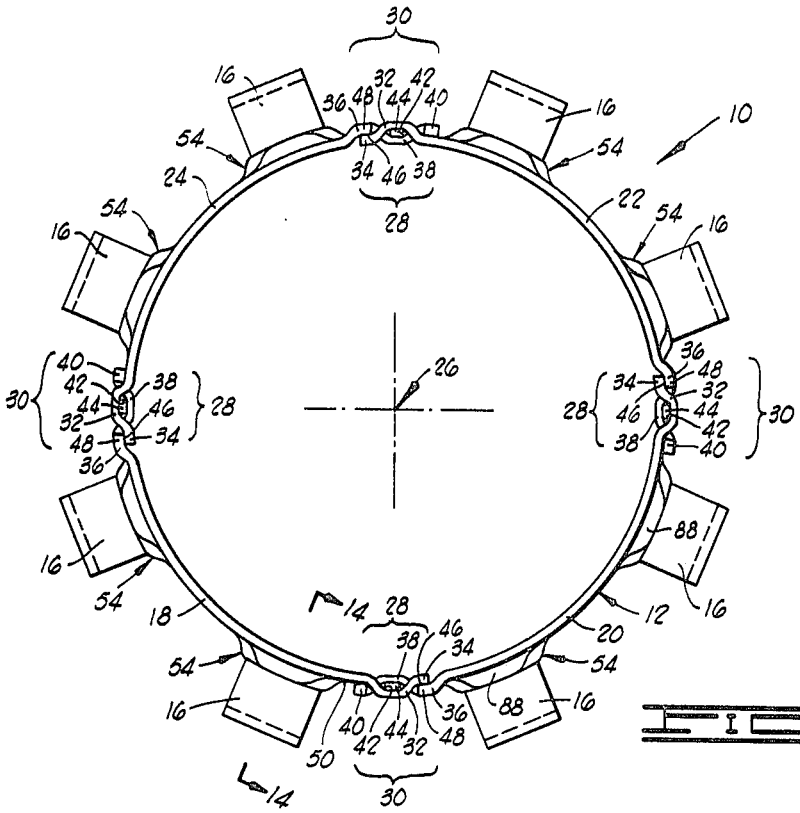
FIG. 2 is a plan view of the centralizer of FIG. 1, showing the four arcuate portions of the collar.

As is best seen in FIG. 2, the upper collar 12 includes first, second, third and fourth arcuate collar portions 18, 20, 22 and 24, respectively, each comprising an angle of 90° about a longitudinal axis 26 of centralizer 10.

Each of said arcuate collar portions include first and second peripheral end portions 28 and 30, respectively.

Each of said first peripheral end portions 28 includes a plurality of radially outward projecting channels 32 with a lip 34 extending from peripherally outer ends thereof in a peripheral direction.

Each of the second end portions 30 includes a radially outward projecting channel 36 adjacent a plurality of radially inward projecting channels 38, which have a lip 40 extending peripherally outward from peripherally outer ends of said channels 38.

The radially outward projecting channels 32 of first end portion 28 of first arcuate collar portion 18 overlap with radially inward projecting channels 38 of the second end portion 30 of the second arcuate collar portion 20, thereby defining an axially extending hole 42 between said channels. A latch pin 44 is received in said axially extending hole 42 to connect said first and second arcuate collar portions, 18 and 20, respectively.

Lip 34 extending peripherally from first peripheral end portion 28 of first arcuate collar portion 18 engages a radially inner surface 46 of a center part 48 of radially outward projecting channel 36 of second collar portion 20.

Peripherally extending lip 40 of second collar portion 20 engages a radially outer surface 50 of first collar portion 18.

As is best seen in FIG. 1, all of the radially outward projecting channels 32 of first collar portion 18 are axially aligned. Similarly, the radially inward projecting channels 38 of second collar portion 20 are also axially aligned.

As is apparent from FIG. 1, any two adjacent radially outward projecting channels 32 of first collar portion 18 have a peripheral slot 52 located therebetween. One of the radially inward projecting channels 38 is disposed in each of said slots 52. Similarly, the radially outward projecting channels 32 can be said to be received within peripheral slots located between adjacent radially inward projecting channels 38.

The radially outward and radially inward projecting channels 32 and 38 of first end portion 28 and second end portion 30, respectively, are said to be rectangular cross-section channels because as viewed in FIG. 2, the axially extending hole 42 defined by the overlapping of said channels is substantially rectangular in cross-section and receives closely therein the latch pin 44 which is also substantially rectangular in cross-section.

Figure 14:
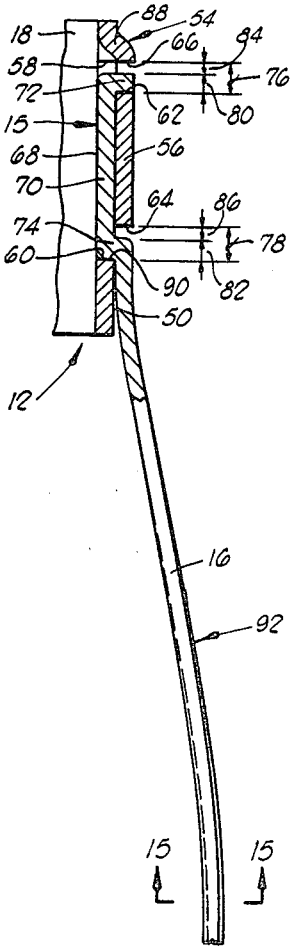
FIG. 14 is a sectional elevation view of a spring member in place within an upper collar, taken along lines 14—14 of FIG. 2.

Each of the arcuate portions of the upper and lower collars 12 and 14 include one or more spring member receiving pockets 54. The construction of the spring member receiving pockets 54 and the spring members 16 is best illustrated in FIG. 14, which is a sectional elevation view taken along lines 14—14 of FIG. 2. Spring receiving pocket 54 includes a continuous peripherally extending bar 56 spaced radially outward from collar 12. Bar 56 is attached, at each peripheral end, to collar 12, and is preferably integrally formed with collar 12, from a single flat sheet of metal. Upper and lower peripheral slots 58 and 60, respectively, are located adjacent upper and lower edges 62 and 64 of bar 56. An upper compression bearing surface 66 extends radially outward from the radially outer surface 50 of the collar portion 18. The bar 56, slots 58 and 60, and upper compression bearing surface 66 are preferably formed in a single stamping operation, although they could be formed in a multiple stamping operation.

Upper end portion 15 of spring member 16 includes a radially inward projecting, peripherally extending channel 68 having a middle part 70 with first and second legs 72 and 74 projecting radially outward substantially perpendicular from said middle part 70. Middle part 70 is located radially inward of peripherally extending bar 56 and said first and second legs 72 and 74 project radially outward through said upper and lower peripheral slots 58 and 60, respectively, so that said peripherally extending bar 56 is received within said peripherally extending channel 68.

Axial widths 76 and 78 of said upper and lower peripheral slots 58 and 60, respectively, and axial thicknesses 80 and 82 of said first and second legs 72 and 74, respectively, are dimensioned so that an axial clearance 84 of said first leg 72 in said upper slots 58 is substantially equal to an axial clearance 86 of said second leg 74 in said lower slot 60. Preferably axial width 76 of upper slot 58 is equal to axial width 78 of lower slot 60. Clearances 84 and 86 are provided to allow a little shack to aid in the alignment of overlapping channels of the collar portions.

The upper compression bearing surface 66 is formed by a radially outward projecting ledge 88 located above upper slot 58. Ledge 88 projects radially outward at least as far as does first leg 72, so that leg 72 will not be likely to hang up on any obstructions in the well bore which might engage the upper collar 12.

Upper edge 62 of peripheral bar 56 comprises an upper tension bearing surface of peripheral bar 56 and said upper tension bearing surface is engaged by first leg 72. A lower edge 90 of lower slot 60 comprises a lower tension bearing surface of collar 12, and said lower tension bearing surface 90 is engaged by second leg 74 when a tensile load is placed across centralizer 10. Lower edge 64 of peripheral bar 56 comprises a lower compression bearing surface of peripheral bar 56 which is engaged by second leg 74 when a compression load is placed across centralizer 10.

Due to the equal axial clearances 84 and 86, when an axial compression load is placed across centralizer 10, the upper end 15 of spring members 16 is moved upward relative to collar 12 so that first leg 72 engages upper compression bearing surface 66 and second leg 74 engages lower compression bearing surface 64.

When a tensile load is placed axially across centralizer 10, the upper end 15 of spring member 16 is moved to the position shown in FIG. 14 with first leg 72 engaging upper tensile bearing surface 62 and lower leg 74 engaging lower tensile bearing surface 90.

Figure 16:
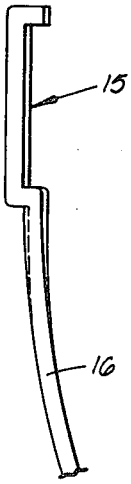
FIG. 16 is a side elevation view of an upper end portion of a spring member, said upper end portion being radially arcuate.

The upper end 15 of spring member 16 may either be made from a flat bar or may be formed in a radially arcuate fashion as illustrated in FIG. 16. The arcuate form is preferred because it presents less interference with a pipe when the centralizer is placed about the pipe.

Spring member 16 further comprises an axially extending radially outward projecting arch portion 92 joining said upper and lower ends 15 and 17. An upper end of arch portion 92 is attached to a radially outer portion of second leg 74.

Figure 15:
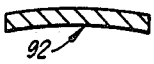
FIG. 15 is a sectional view of the arch portion of the spring member of FIG. 14, taken along lines 15—15.

As is illustrated in FIG. 15 which is a cross-sectional view of FIG. 14 taken along lines 15—15, a central part of arch portion 92 is radially arcuate.

Lower ends 17 of spring members 16 are attached to lower collar 14 in a similar manner.

Figure 18:
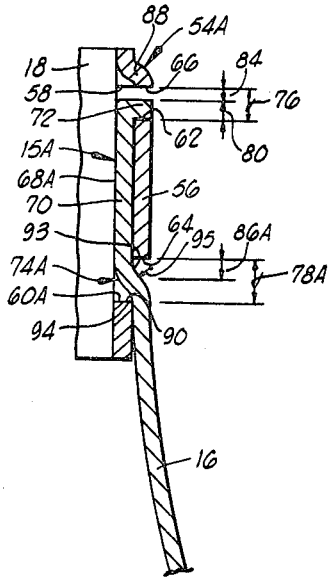
FIG. 18 is a view similar to FIG. 14, illustrating an alternative embodiment of spring receiving pocket and spring member end.

An alternative form of spring receiving pocket 54A and upper spring end 15A is shown in FIG. 18, which is a view similar to FIG. 14. Like parts of FIGS. 14 and 18 are indicated with like numerals. Those parts of FIG. 14 which have been modified in FIG. 18 are given a suffix "A".

Lower slot 60A is modified in that an axial width 78A thereof is greater than axial width 76 of upper slot 58.

Peripherally extending channel 68A is modified in that second leg 74A no longer projects perpendicular to middle part 70, but rather projects outward and downward at an acute angle to middle part 70. Second leg 74A is formed by making first and second sharply radiused bends 93 and 94, respectively, in spring 16. For the purpose of this disclosure, a relatively sharply radiused bend is defined as a bend having a radius between one half and two times the thickness of the metal bar being bent. Preferably, such a bend has a radius of curvature approximately equal to the thickness of the metal bar.

FIG. 18 shows the position of upper end 15A within pocket 54A when the centralizer is loaded in tension. Upper leg 72 bears against upper tension bearing surface 62 and lower leg 74A bears against lower tension bearing surface 90. This is similar to the first embodiment illustrated in FIG. 14. When the tension load is first placed on the centralizer, lower leg 74A first engages lower tension bearing surface 90, then as spring 16 yields a bit, upper leg 72 engages upper tension bearing surface 62, so that both tension bearing surfaces carry the tension load.

The operation of the alternative embodiment of FIG. 18 is, however, somewhat different from that of FIG. 14 when the centralizer is loaded in compression. An axial clearance 86A, through which lower leg 74A must be moved before it can engage lower compression bearing surface 64, is greater than axial clearance 84 of upper leg 72.

Therefore, when the embodiment of FIG. 18 is loaded in compression, the load is generally only carried by upper compression bearing surface 66. Redundancy in available bearing surfaces is still provided, however, because if outward projecting ledge 88 were to yield due to an excessive compressive loading, the second leg 74A would then engage lower compression bearing surface 64 to prevent failure of the connection between spring 16 and collar portion 18.

In a preferred version of the embodiment of FIG. 18, the bar stock from which spring 16 is formed has a thickness of 0.210 inch. Axial width 76 equals 0.313 inch. Axial width 78A equals 0.406 inch. A radius of curvature 95 of first bend 93 equals 0.187 inch. Second bend 94 has a similar radius.

Figure 3:
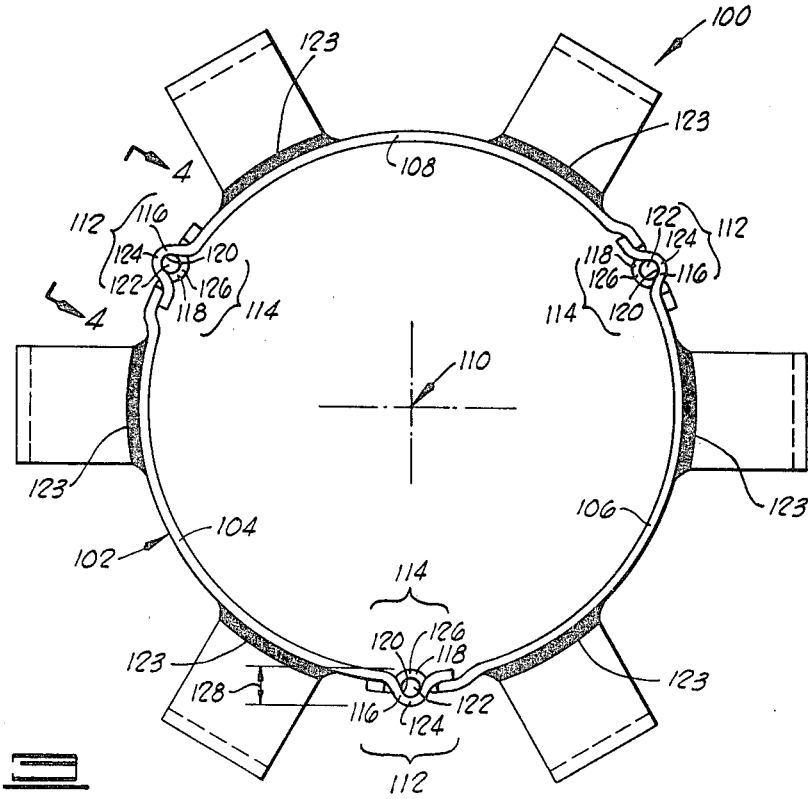
FIG. 3 shows a plan view of an alternate embodiment of the centralizer of the present invention, having three arcuate collar portions, and with round latch pins.
Figure 3:
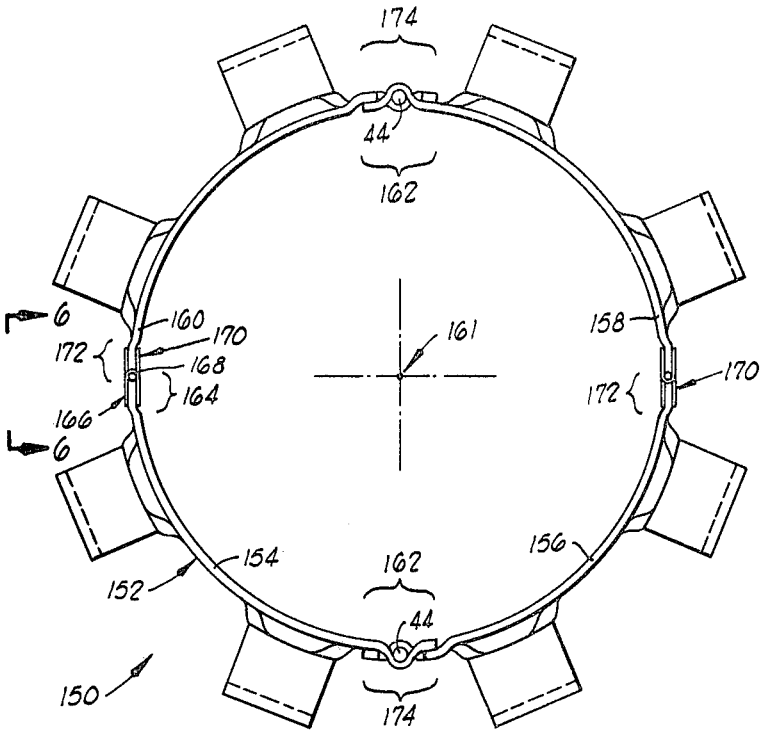

Referring now to FIG. 3, an alternative embodiment of the present invention is shown and generally designated by the numeral 100. Centralizer 100 is similar to centralizer 10 except that each of the collar portions includes only three arcuate collar portions and the channels of those collar portions are round channels as will further be explained below.

Centralizer 100 includes upper collar 102 which is comprised of first, second and third arcuate collar portions 104, 106 and 108, each of which comprises an angle of 120° about central axis 110.

Each of the arcuate collar portions 104, 106 and 108 include first peripheral end portions 112 and second peripheral end portions 114.

First and second peripheral end portions 112 and 114 are similar in construction to first and second peripheral end portions 28 and 30 of FIG. 2 with the exception of the configuration of the radially outward projecting channel 116 of first end portion 112 and the radially inward projecting channel 118 of second end portion 114.

Channels 116 and 118 are round channels and their overlapping portions from an axial hole 120 having a round cross-section for closely receiving a round latch pin 122. Preferably, middle parts 124 and 126 of channels 116 and 118, respectively, are thinned out so as to be thinner than the remainder of the channels. This reduces a radical thickness 128 of the joints between the collar portions, and also reduces the overall outside diameter of upper collar 102.

Also, centralizer 100 has welded collar to spring connections 123 instead of the pocket type connections shown in FIG. 14.

Figure 4:
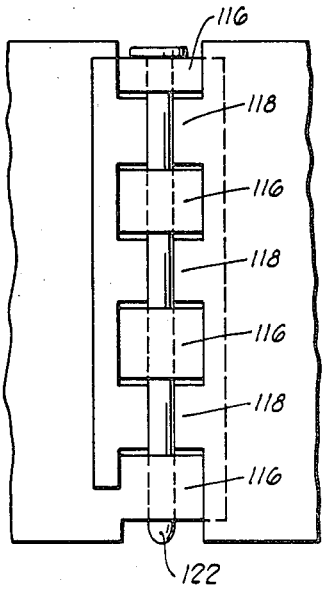
FIG. 4 is an elevation view of that part of the upper collar of FIG. 3 viewed along lines 4—4 showing the round latch pin and associated overlapping round channels of the collar portions.

FIG. 4 is a partial elevation view taken along lines 4—4 of FIG. 3 showing the arrangement of overlapping channels 116 and 118 in a manner similar to that shown in FIG. 1.

Figure 5:
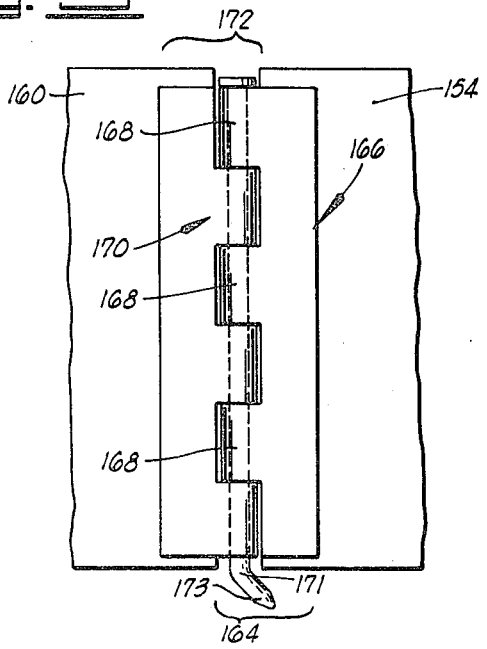
FIG. 5 is a plan view of another alternative embodiment of the centralizer of the present invention showing an upper collar comprising four arcuate parts having rectangular channel connecting portions at one end and wrap-around hinge portions at the other end.

FIG. 5 shows a third embodiment of the centralizer of the present invention which is shown and generally designated by the numeral 150.

Centralizer 150 of FIG. 5 includes an upper collar 152 having first, second, third and fourth arcuate collar portions 154, 156, 158 and 160, respectively, each of which comprises an arc of 90° about central axis 161 of centralizer 150.

First collar portion 154 includes a first peripheral end portion 162 which is similar to first peripheral end portion 112 of FIG. 3. A second peripheral end portion 164 of collar portion 154 is, however, different from the second peripheral end portion 114 of collar portion 104 of FIG. 3.

Second peripheral end portion 164 includes a wrap-around hinge half 166 which includes a plurality of peripherally projecting loops 168. Wrap-around hinge half 166 is constructed for engagement with a complementary wrap-around hinge half 170 of a first peripheral end portion 172 of fourth arcuate collar portion 160.

Third arcuate collar portion 158 is identical in construction to first arcuate collar portion 154. Second arcuate collar portion 156 is identical in construction to fourth arcuate collar portion 160.

Second arcuate collar portion 156 includes a second peripheral end portion 174 similar to second peripheral end portion 114 of second arcuate collar portion 106 of FIG. 3.

Referring now to FIG. 6, a partial elevation view of the connection between first collar portion 154 and fourth collar portion 160 is shown. The overlapping loops of hinge halves 166 and 170 are connected together by pivot pin 171. Pivot pin 171 typically is of such a length that a lower end 173 thereof can be bent to retain pin 171 in place. The connection between second collar portion 156 and third collar portion 158 is identical.

Figure 7:
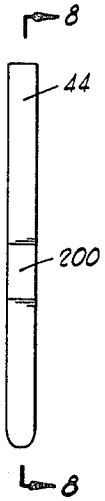
FIG. 7 is an elevation view of a rectangular cross-section latch pin, with an offset.
Figure 8:
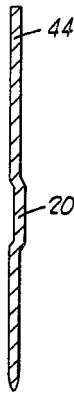
FIG. 8 is a side elevation view of the latch pin of FIG. 7, taken along lines 8—8.

Referring now to FIG. 7, an elevation view of rectangular cross-section latch pin 44 is shown. Latch pin 44 includes an offset deformation 200. Deformation 200 is best seen in FIG. 8 which is cross-sectional view of FIG. 7 taken along lines 8—8 of FIG. 7. The offset deformation 200 serves to allow the latch pin 44 to be tightly received within rectangular axial hole 42 of FIG. 2 so that first and second arcuate portions 18 and 20 of centralizer 10 are rigidly held together.

An alternative embodiment of latch pin 44 deletes the offset portion 200 so that the latch pin 44 is not so tightly received within axial hole 42.

Figure 9:
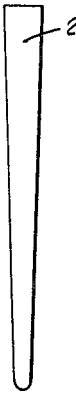
FIG. 9 is an elevation view of an axially tapered rectangular cross-section latch pin.

FIG. 9 shows an elevation view of a rectangular cross-section latch pin 202 which has an axial taper as is seen in FIG. 9. Latch pin 202 may be used in place of offset latch pin 44 and achieves a rigid connection between first and second collar portions 18 and 20 due to the wedging effect of the tapered pin.

Figure 10:
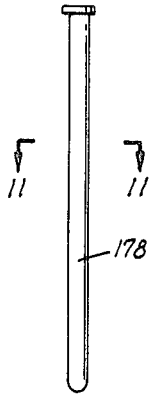
FIG. 10 is an elevation view of an oval cross-section latch pin.
Figure 11:
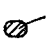
FIG. 11 is a cross-sectional view of the latch pin of FIG. 10 taken along lines 11—11.

FIGS. 10 and 11 show an oval cross-section latch pin 178. Such a latch pin may be used in place of round latch pin 122 to reduce the required thickness 128 of the joint between overlapping round channels.

Figure 12:
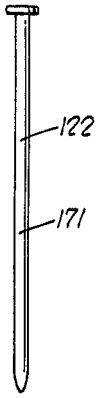
FIG. 12 is an elevation view of a round latch pin or hinge pin.

FIG. 12 shows a round cross-section latch pin 122 which may also be used as hinge pin 171 for the wrap-around hinge of FIG. 6.

Figure 13:
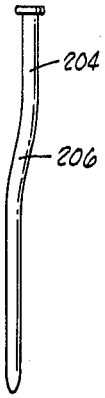
FIG. 13 is an elevation view of a round latch pin with an offset.

FIG. 13 illustrates a round cross-section latch pin 204 having an offset 206 therein. The offset round latch pin 204 is used with a collar having a round axial hole such as hole 120 of FIG. 3. The offset latch pin causes the latch pin 204 to be tightly received within axial hole 120 so as to more rigidly connect first and second collar portions 104 and 106 of FIG. 3.

All the various embodiments discussed up to this point have only two springs per arcuate collar portion. They have either six or eight springs 16 and therefore have either three or four arcuate collar portions, respectively.

So long as there are only two springs 16 per arcuate collar portion, the pocket type connections between springs and collars, illustrated in FIGS. 14 and 18, may be used and the centralizer will completely knockdown. That is, it may be completely disassembled and then reassembled. Generally, the complete knockdown type centralizer, such as shown in FIGS. 2 and 5, is shipped to the job site in completely disassembled form, and then is assembled on the job site.

Figure 19:
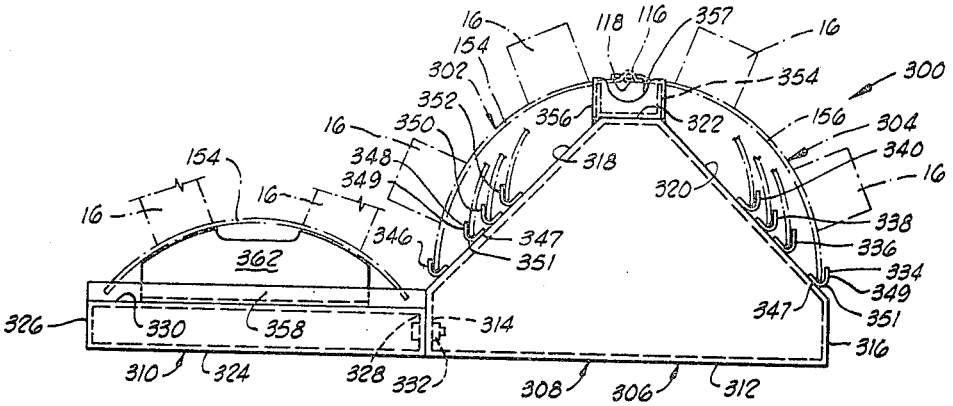
FIG. 19 is an end view of a jig fixture for use in assembling the centralizer of the present invention.
Figure 20:
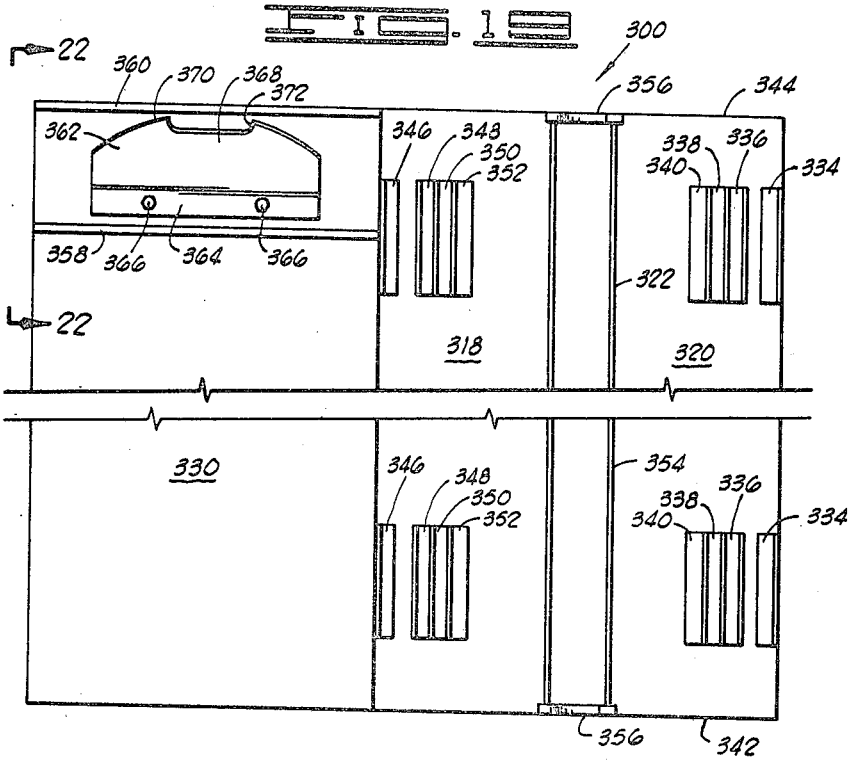
FIG. 20 is a plan view of the jig fixture of FIG. 19.
Figure 22:
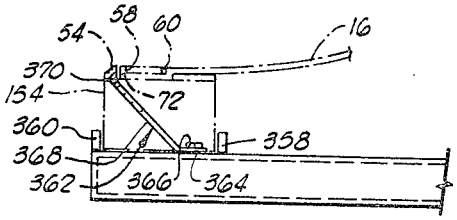
FIG. 22 is a side elevation view of a portion of the jig fixture of FIG. 20, taken along lines 22—22.

FIGS. 19, 20 and 22 illustrate a jig fixture 300 for use in assembling the knockdown type centralizers. An end view of portions of a centralizer like centralizer 150 of FIG. 5 are illustrated in phantom lines in place on the jig 300. Upper and lower first arcuate collar portions 154 are assembled with two springs 16 to form a first arcuate collar portion assembly 302. Assembly 302 is then set in place on jig 300 as shown. Then upper and lower second arcuate collar portions 156 are assembled with two springs 16 to form a second arcuate collar portion assembly 304 which is also set in place on jig 300, and the channels 116 of the first assembly overlap with the channels 118 of the second assembly.

The jig 300 includes a frame 306, comprised of first and second frame portions 308 and 310.

First frame portion 308 includes a bottom 312, first and second sides 314 and 316, first second sloped top portions 318 and 320, and middle horizontal top portions 322.

Second frame portion 310 includes a bottom 324, first and second sides 326 and 328, and a top 330. Second side 328 of second frame portion 310 and first side 314 of first frame portion 308 are connected by a plurality of bolts 332.

Attached to second sloped top portion 320 are a plurality of successively inwardly located second collar assembly supports 334, 336, 338 and 340. A set of such first collar assembly supports is located near each of first and second ends 342 and 344 of second sloped top portion 320.

Similarly, first collar assembly supports 346, 348, 350 and 352 are attached to first sloped top portion 318.

Each collar assembly support includes first and second legs 347 and 349, with a rounded middle portion 351 connecting legs 347 and 349. First legs 347 serve as a means of attachment to either sloped top surface 318 or 320, and preferably are welded thereto. Second legs 349 project vertically upward and provide a side stop means for engagement with a radially outer surface of one of the collar portions 154 or 156 to retain the collar portion assemblies 302 and 304 in place on jig fixture 300.

An inverted U-shaped channel 354 is attached to middle top portion 322. At each end of channel 322 is a back up plate 356. Each back up plate 356 has a semicircular opening 357 disposed therein.

Attached to top surface 330 of second frame portion 310 are first and second collar portion placement bars 358 and 360. Located between bars 358 and 360 is a spring end cam plate 362.

Cam plate 362 includes a base portion 364 attached to top portion 330 of second frame portion 310 by bolts 366. Cam plate 362 includes angled portion 368 having an arcuate upper end 370 with an opening 372 disposed therein.

A knockdown centralizer like centralizer 150 of FIG. 5 is assembled using jig 300 as follows. A collar portion 154 is placed between collar placement bars 358 and 360 as shown in phantom lines in FIG. 22. Two spring members 16 are then engaged with spring receiving pockets 54, as shown in FIG. 22. Each spring member 16 is first placed through lower slot 60. First leg 72 engages cam plate 362 and is guided into place in upper slot 58.

Spring members 16 and collar portion 154 will remain in place as shown in FIG. 22 while a lower collar portion 154 is slipped in place over the other ends of spring members 16. Then the assembled first collar portion assembly is placed upon first frame portion 308 as shown in phantom lines in FIG. 19. Second collar portion assembly 304 is then assembled in a similar fashion and also placed on first frame portion 308.

Latch pins are then placed in the axial holes defined by overlapping channels 116 and 118. Back up plates 356 engage collar portion assemblies 302 and 304 to prevent them from moving axially when the latch pins are driven into place. Openings 357 are positioned adjacent a location where said first and second collar portion assemblies 302 and 304 overlap so that the latch pin 122 may protrude past back up plate 356.

In a preferred embodiment, first and second collar portion supports 346 and 334 are constructed to support a centralizer 150 designed for use with 13⅜ inch pipe. The side stops or second legs 349 of supports 346 and 334 are spaced apart a distance approximately equal to an outer diameter of a centralizer 150 designed for use with 13 3/9 inch pipe.

Similarly, supports 348 and 336 are constructed to support collar portions of a smaller radius than those supported by supports 346 and 344.

The jig 300 therefore provides a means of assembling a number of different sizes of centralizers 150. The jig 300 permits one-half of a centralizer 150 to be assembled by the insertion of latch pins 122. Once the latch pins 122 are inserted, that half of the centralizer 150 is rigidly assembled so that it is then substantially as structurally sound as would be a centralizer made from 180° arcuate collar portions. The overlapping channels 116 and 118 and peripherally extending lips thereof are wedged tightly together by latch pins 122.

Figure 21:
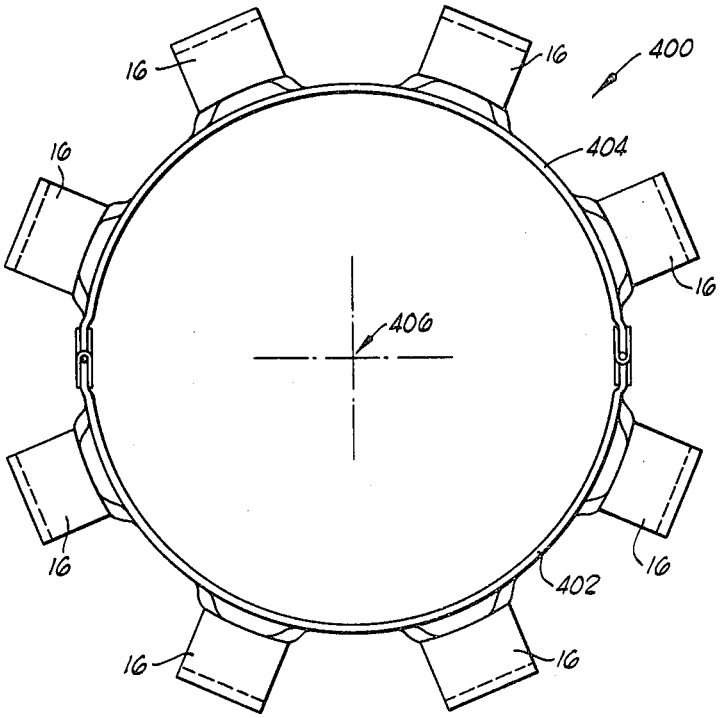
FIG. 21 is a plan view of still another alternative embodiment of the centralizer of the present invention, having two arcuate collar portions.

FIG. 21 illustrates still another embodiment of the present invention and shows a centralizer 400. Centralizer 400 includes two arcuate collar portions 402 and 404, each circumscribing an angle of 180° about a central axis 406 of centralizer 400. The peripheral ends of collar portions 402 and 404 are joined together by hinge assemblies such as those illustrated in FIG. 6.

Each of the collar portions is connected to four springs 16 by pocket type connections such as those shown in either FIG. 14 or FIG. 18.

The centralizer 400 can not be completely knocked down, that is it may not be completely disassembled.

When using the pocket type connections of FIG. 14 or 18, the number of springs which may be assembled in any collar portion will be limited by the diameter to which the collar portion is formed. That is, as the collar portion is formed to larger diameters, three or more springs may be assembled thereto while a collar portion formed to a small diameter may be assembled with two springs.

There are, however, applications where it is economically more desirable to use 180° collar portions without overlapping channels due to the lesser cost of their manufacture as compared to some of the previously discussed embodiments.

These 180° arcuate collar portions, with either three or four springs 16, are constructed as follows. First, flat pieces of bar stock are stamped to form the spring member receiving pockets 54. Then, the spring members 16 are assembled with the still flat collar portions. Finally, the collar portions, with the spring members 16 connected thereto, are formed into their arcuate shape. After the collar portions are formed into their arcuate shape, it is not possible to remove the spring members 16 therefrom.

It will be apparent to those skilled in the art that numerous other combinations can be made of the various features of the several embodiments of the present invention illustrated in this disclosure to comprise further variations upon the design which still are included within the scope and spirit of this invention as defined by the appended claims.

Depending upon the size of the pipe to be received within the collars of the centralizer, the number of arcuate portions into which the collar will be broken will vary. For example, for smaller diameter pipes up to about 7⅝ inches in diamter, the collars will preferably be made in two pieces comprising 180° segments. Those centralizers will be formed by the methods just described with relation to FIG. 21. If desirable, those smaller centralizers can also be made in any of the full knockdown versions previously described, limited only by the ability to form the spring receiving pockets 54 within the physical dimensions of the collars.

It will also be apparent that any of the different connections described in relation to the various embodiments above can be used to connect the arcuate collar portions. Various combinations have differing desirable characteristics. For example, the embodiment of FIG. 5 is very well adapted to installation of the centralizers upon the pipe by only one man. All components of the centralizer except for one of the hinge pins 171 may be assembled prior to placing the centralizer around the pipe. The centralizer is opened about the first hinge pin 171 which is already in place, and is placed around the pipe. The two halves of the centralizer are then pivoted back together and the second hinge pin 171 is put in place.

An embodiment such as centralizer 10 of FIG. 2 or centralizer 100 of FIG. 3 is a bit more difficult to install, but is very advantageous in its fabrication since each of the collar portions of the respective collars are identical. This eliminates the need for matching complementary collar portions as is necessary in the embodiment of FIG. 5.

Figure 17:
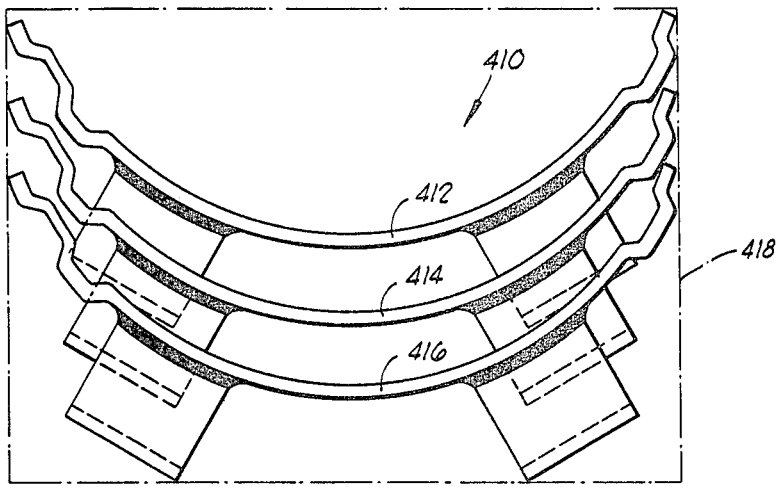
FIG. 17 is an end elevation view of a disassembled three part centralizer, with welded springs, packed in a shipping crate.

Referring now to FIG. 17, there is there illustrated a centralizer 410. Centralizer 410 is similar to centralizer 100 in FIG. 3 in that they both include three arcuate collar portions comprising angles of 120°. The collar portions 412, 414, and 416 are similar to collar portions 104, 106 and 108 except that their overlapping channel portions are rectangular in the embodiment of centralizer 410 as opposed to the round channels of FIG. 3.

FIG. 17 illustrates the space efficient manner in which the centralizers of the present invention may be stored and shipped, even when using welded springs.

FIG. 17 shows the three collar portions 412, 414 and 416 cradled or nested, one within the other, and stacked within a box 418.

Thus, it is seen that the centralizer of the present invention is well adapted to obtain the ends and advantages mentioned as well as those inherent therein. Although specific embodiments of the invention have been illustrated for the purpose of this disclosure, many variations upon those embodiments will be apparent to those skilled in the art and are within the scope and spirit of this invention as defined by the appended claims.

What is claimed is:

1. A method of manufacturing a centralizer of the type having an upper and a lower collar connected by a plurality of spring members, said collars including a plurality of arcuate collar portions with each collar portion being connected to at least two spring members by means of spring member receiving pockets which receive ends of the spring members, said method comprising the steps of:

forming said spring member receiving pockets in an upper and a lower flat collar portion;

assembling said upper and lower flat collar portions with at least two of said spring members; and forming said flat collar portions into arcuate collar portions while said spring members are assembled therewith.

2. The method of claim 1 wherein said step of forming is further characterized as forming said flat collar portions into 180° arcuate collar portions.

3. The method of claim 1, wherein each collar portion is connected to at least three spring members, and said step of assembling is further characterized as:

assembling said upper and lower flat collar portions with at least three of said spring members.

4. The method of claim 3 wherein said step of forming is further characterized as forming said flat collar portions into 180° arcuate collar portions.

* * * * *